United States Patent [19]

Kam et al.

[11] 4,357,065

[45] Nov. 2, 1982

[54] TERMINAL FOR CONNECTION TO A FLAT CONDUCTOR

[75] Inventors: Lit-Yan Kam, Camp Hill; Billy E. Olsson, New Cumberland, both of Pa.

[73] Assignee: AMP Incorporated, Harrisburg, Pa.

[21] Appl. No.: 159,018

[22] Filed: Jun. 13, 1980

[51] Int. Cl.[3] ..... H01R 4/24

[52] U.S. Cl. ..... 339/97 R; 339/17 F

[58] Field of Search ..... 339/97 R, 97 P, 176 MF, 339/17 F, 97 C, 276 R

[56] References Cited

U.S. PATENT DOCUMENTS

| | | | |
|---|---|---|---|
| 2,302,767 | 11/1942 | Hackbarth | 173/269 |
| 2,680,235 | 6/1954 | Pierce | 339/97 |
| 3,715,457 | 2/1973 | Teagno et al. | 339/97 R X |
| 3,997,233 | 12/1976 | Evans | 339/97 C |
| 4,065,199 | 12/1977 | Andre et al. | 339/17 F |
| 4,066,319 | 1/1978 | Baker et al. | 339/97 R |
| 4,106,836 | 8/1978 | Asick et al. | 339/97 C |

*Primary Examiner*—Eugene F. Desmond

*Attorney, Agent, or Firm*—Gerald K. Kita

[57] ABSTRACT

An electrical terminal is disclosed for electrical connection to a flat conductor. A lance of the terminal is impaled into one side of the conductor. A pair of tines on the terminal are curled back along themselves, straddling opposite sides of the lance and pressing the impaled conductor against the straddled sides of the lance.

8 Claims, 10 Drawing Figures

TERMINAL FOR CONNECTION TO A FLAT CONDUCTOR

FIELD OF THE INVENTION

The invention relates to a miniature, free standing electrical terminal for establishing a reliable, electrical connection with a flat conductor.

BACKGROUND OF THE PRIOR ART

One or more flat conductors are mounted along a ribbon or sheet of flexible dielectric to comprise a flexible cable or a flexible circuit. The conductors may be fully covered by the dielectric, or alternatively, uninsulated along their sides which face away from the flexible dielectric. The conductors are narrow and closely spaced. For example, the conductors may be located axially along centerlines 0.100 inches apart, with 0.038 inches separating edges of adjacent conductors. A need has existed for electrical terminals of miniature size, yet sturdy enough to withstand penetration through the dielectric and also pressure crimped connection with the conductors. Desirably the terminals should be free standing, i.e., standing without support by an insulative housing. U.S. Pat. Nos. 3,395,381; 4,002,393; 4,106,836; and 4,082,402 disclose typical, free standing terminals.

SUMMARY OF THE INVENTION

The present invention relates to a free standing, miniature electrical terminal adapted for machine installation on a flexible, flat conductor. Both the conductor and the terminal are aligned accurately by the tooling prior to installation. Further invention resides in a terminal fabricated from a stamped and formed metal blank in which wasted or nonutilized areas are minimized to produce a terminal of inherent simplicity and miniature size.

A flat plate portion of the terminal which establishes electrical connection with a conductor is formed with a rigid columnar lance adapted to impale into a first side of a flexible, flat conductor. When the lance emerges from a second side of the conductor, portions of the conductor, which contact the sides of the lance, are raised outwardly relative to the plane of the remaining flat conductor. The plate further includes a pair of insulation penetrating, spaced apart tines which are curled in directions back along themselves, penetrating a second side of the conductor. Any tendency for the tines to uncurl, presses the tines even more tightly against the conductor. The curled tines straddle opposite sides of the lance, wedging the raised portions of the conductor tightly against the straddled sides of the lance.

OBJECTS OF THE INVENTION

An object of the present invention is to provide a stamped and formed, free standing, miniature terminal for electrical connection with a flexible, flat conductor.

Another object is to provide an electrical terminal which is suitable for machine installation on a flexible, flat conductor, and which is designed to allow machine alignment of both the conductor and terminal prior to installation.

Another object is to provide an electrica connection between a flexible, flat conductor and a terminal which utilizes a rigid columnar lance, impaled in one side of the conductor, and a pair of tines, curled back along themselves, penetrating a second side of the conductor, and wedging raised portions of the conductor against those sides of the lance straddled by the tines.

Another object is to provide a pluggable connection between flexible circuitry and an array of pins having cross sections which, for example, are round or square.

Other objects and advantages of the present invention will become apparent from the following detailed description taken in conjunction with the drawings.

DETAILED DESCRIPTION

Figure 1:
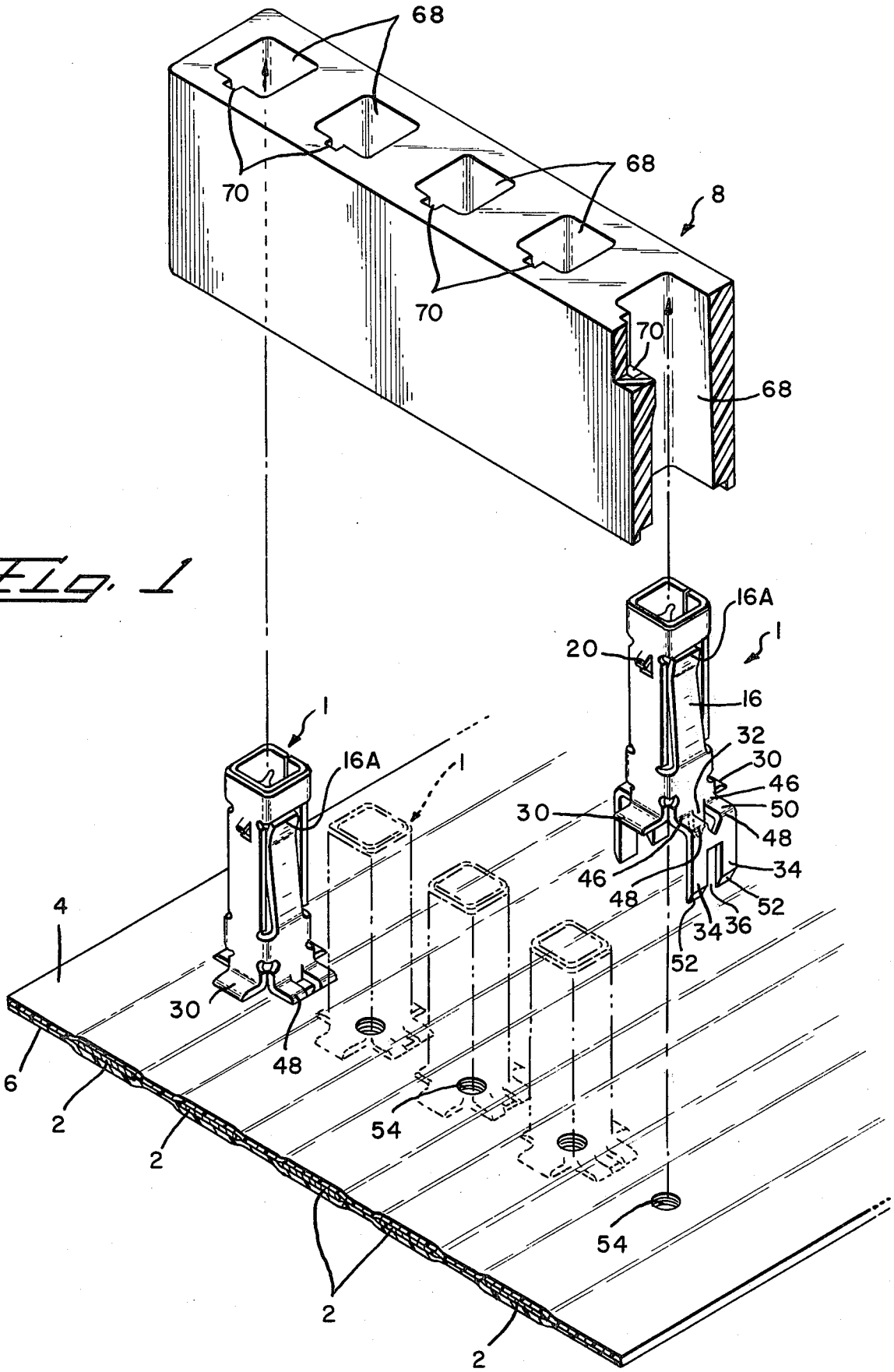
FIG. 1 is an enlarged, fragmentary perspective of an array of insulated, flat conductors, together with plural electrical terminals according to a preferred embodiment thereof. One of the terminals is shown exploded and in a form prior to connection with a corresponding conductor. Another terminal is shown connected to a corresponding conductor. A housing for the terminals is shown exploded above the terminals.

With reference to FIG. 1, electrical terminals, shown generally at 1, are adapted for electrical connection to corresponding flexible, flat conductors 2 contained in laminated sheets of dielectric 4 and 6. A housing shown generally at 8 is adapted for assembly over the terminals 1.

Figure 4:
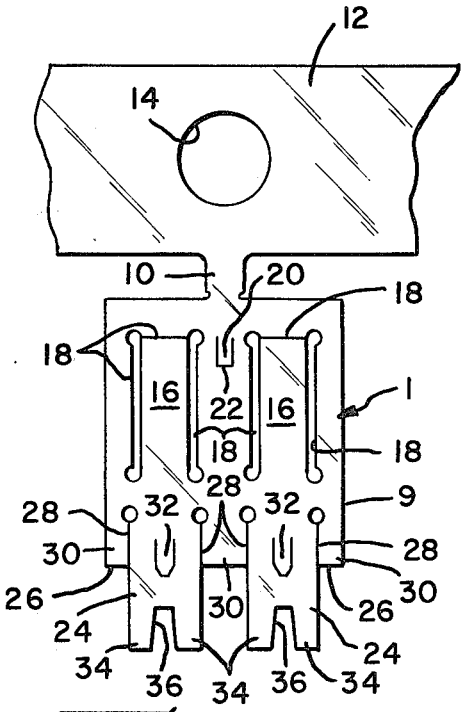
FIG. 4 is a plan view of a stamped, flat blank prior to being formed into the terminal shown in FIG. 3.

FIG. 4 illustrates a terminal 1 in the form of a single piece, flat metal blank defined between side edges 9. The blank is frangibly connected to an integral stem 10 which depends from a carrier strip 12 illustrated with one of the pilot holes 14 provided along the length of the carrier strip. A pair of elongated spring fingers 16 are defined by respective multilateral slits 18 formed by stamping through the thickness of the blank. A smaller, finger like tab 20, spaced between the spring fingers, is defined by a multilateral slit 22.

A pair of plates 24 are stamped to project outwardly from an edge 26 of the blank. Opposite side edges of the plates are continuous along slits 28 which project into the blank from the edge 26. The slits 28 define side edges of tabs 30 which are along the edge 26. The ends of the slits 18 and 28 terminate in round apertures which prevent propogation of cracks or tears in the blank.

Figure 8:
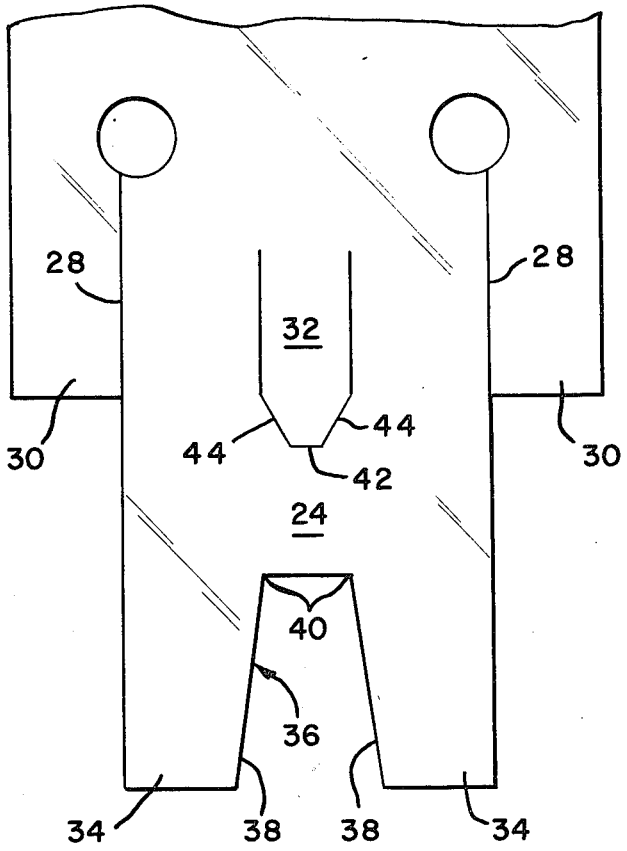
FIG. 8 is an enlargement of a portion of FIG. 4.

Each plate 24 is provided with a lance or tab 32 defined by a multilateral slit stamped through the thickness of the blank. The free end of each plate 24 is provided with a bifurcated portion comprising a pair of elongated tines 34 spaced apart from each other by a notch 36. FIG. 8 illustrates each notch 36 with an enlarged open end defined between tapered edges 38 merging with side edges 40 on the remainder of the slot. The notch width between the edges 40 is equal to the width of the lance. In a blank of 0.006 thick phosphor bronze the width of the lance is 0.012 inches. The free end 42 of the lance is 0.004 inches wide and is flanked on either side by edges 44 tapered at 60 degrees.

Figure 2:
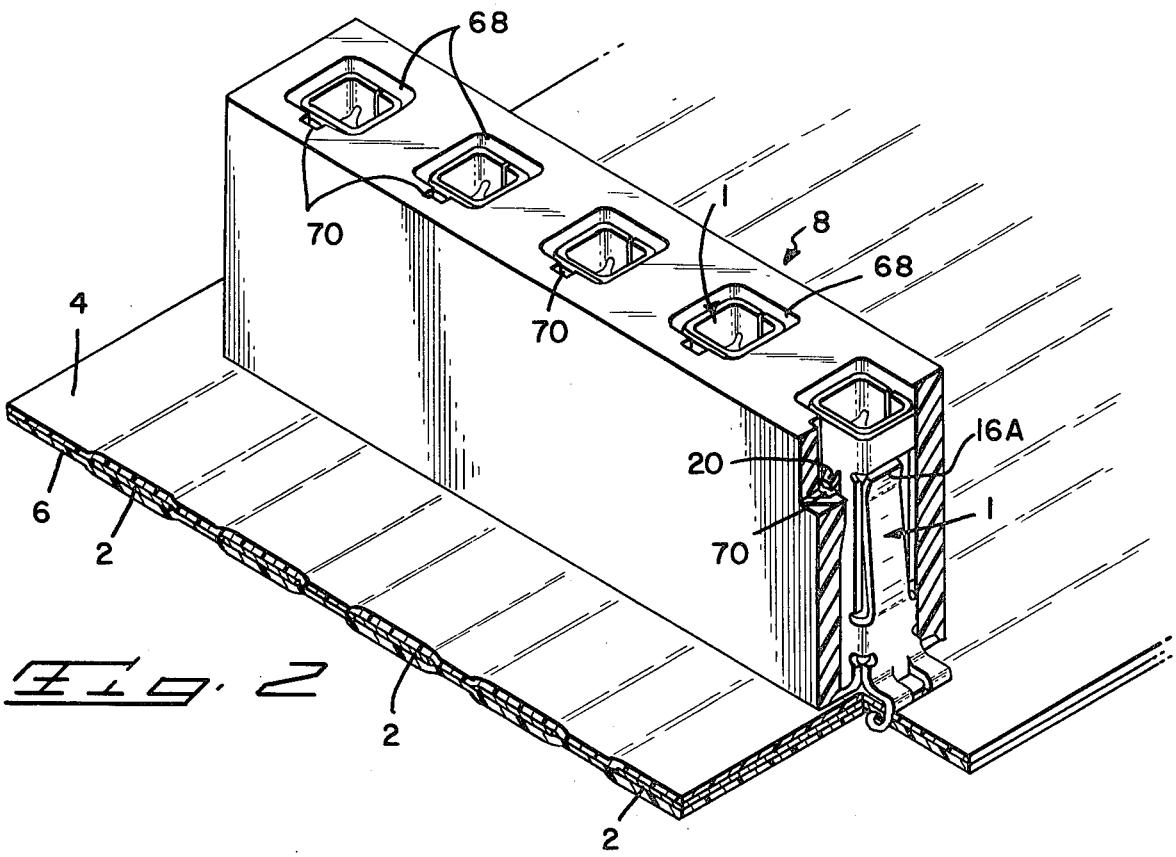
FIG. 2 is a view similar to FIG. 1 illustrating the parts assembled.
Figure 3:
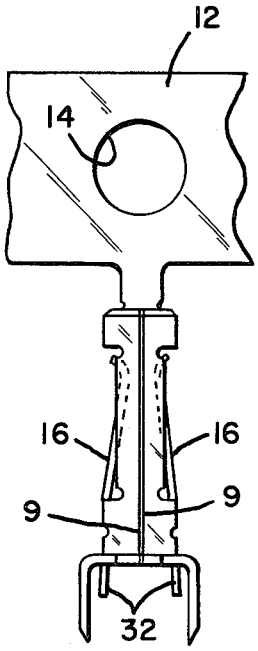
FIG. 3 is an enlarged elevation of a preferred embodiment of a terminal integral with a carrier strip.

FIGS. 2 and 3 show a box shaped receptacle type terminal formed from the blank illustrated in FIG. 4. More particularly, the blank is folded into a four sided box, with the folds sharply defined along the aligned portions of respective slits 18 and 28. The side edges 9 of the blank are coplanar and closed against each other. The fingers 16 oppose each other on opposite sides of the box, and are bent to project diagonally toward each other into the box. The free ends are bent to curve away from each other. The fingers serve to grip resiliently a post type electrical terminal, not shown, when the same is plugged into the receptacle. The tab 20 is bent to project diagonally out of the side of the box. The lances 32 are on opposite sides of the box and are splayed diagonally away from each other, for example at 5 degrees. Each plate 24 includes a first bend or fold 46 and a second, reverse direction bend or fold 48 defining therebetween a leg portion 50 projecting outwardly from a respective side of the box and outwardly of the plane of the respective lance. The bends 46 and 48, as well as the leg portion 50, are bifurcated by an opening left by the absent lance 32. The tines 34 of a respective plate are offset from the plane of a corresponding lance 32 by a leg or transverse bridging portion 50 which integrally joins the root ends of the tab and the bifurcated portion. The tines 34 and a corresponding lance 32 project from the same open end of the box. The ends of the tines are provided with chamfered chisel edges 52. The tabs 30 are bent outwardly of the planes of the respective box sides and are coplanar with the leg portions 50 for a purpose to be described.

Connection of the terminal 1 to a conductor 2 is described by reference to FIGS. 5A, 5B, 6 and 7. FIG. 6 shows a conductor 2 punched or drilled with an aperture 54 along the centerline of the conductor, passing through the dielectrics 4 and 6. The aperture designates a location on the array for a terminal 1 and assists in alignment of both a terminal 1 and the apertured conductor 2 by applicator tooling. The target pattern is imaginary, and designates the areas 32A and 34A to be impacted by the lances 32 and the tines 34, respectively.

Figure 5A:
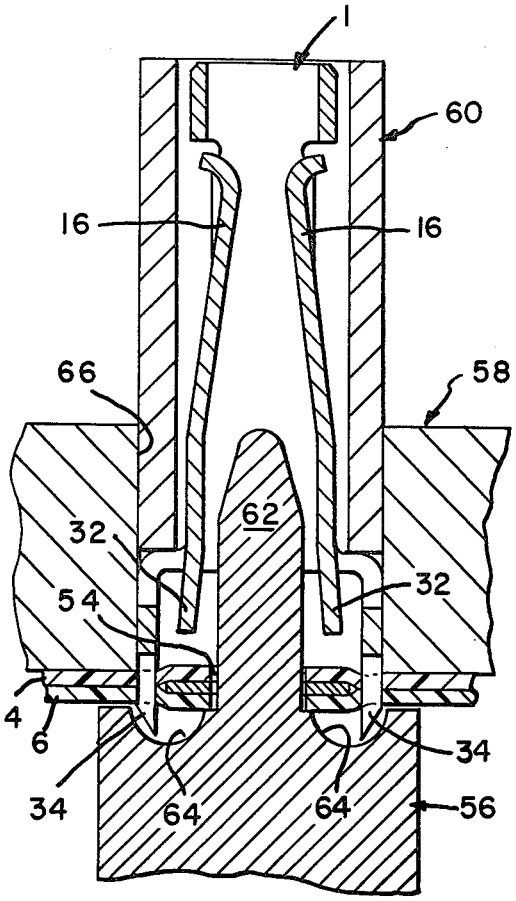
FIGS. 5A and 5B are fragmentary elevations in section illustrating applicator tooling apparatus installing a terminal onto one conductor of the array shown in FIG. 1.
Figure 5B:
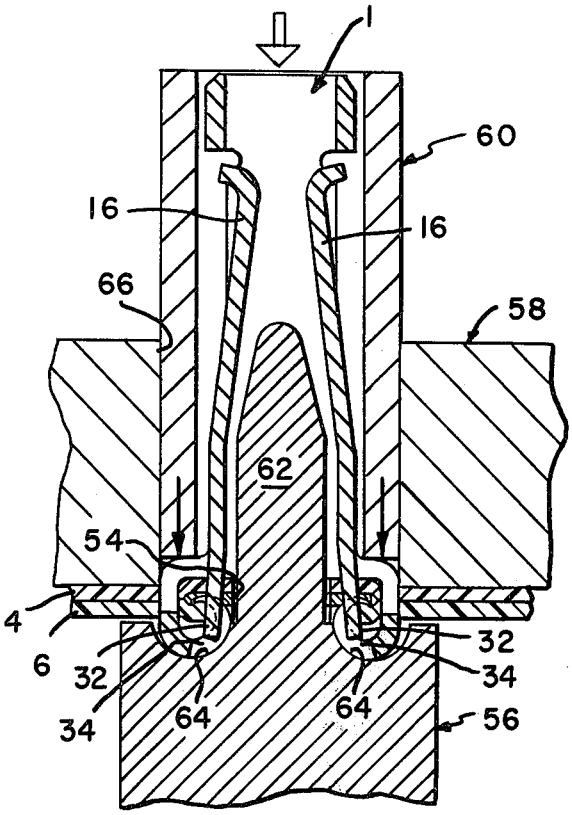
Figure 6:
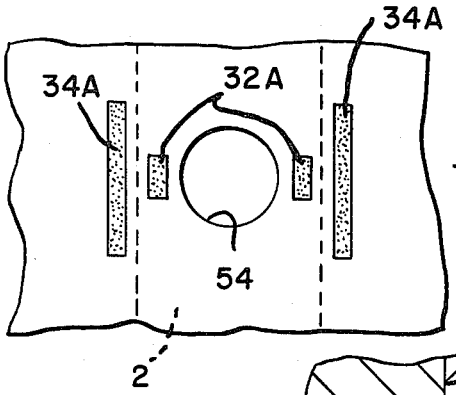
FIG. 6 is a fragmentary plan of a conductor in the array shown in FIG. 1, illustrating an alignment aperture and an imaginary target pattern to be penetrated by a terminal, when the same is installed on the conductor.
Figure 7:
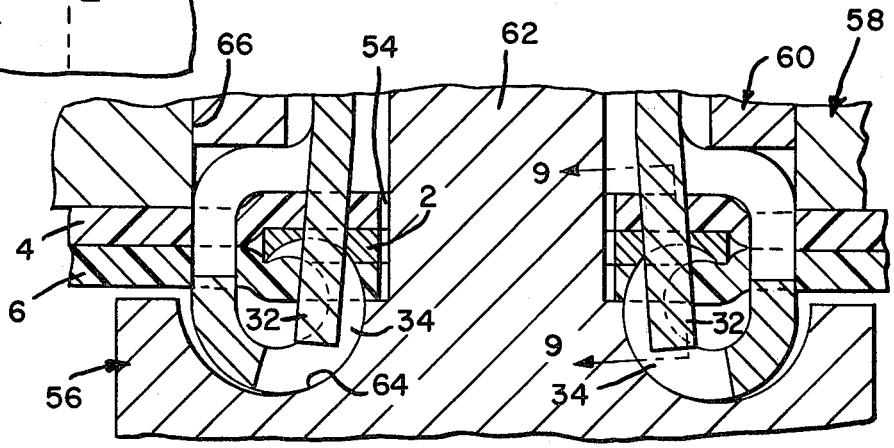
FIG. 7 is an enlarged view of a portion of FIG. 5B illustrating the details of a pair of electrical connections.

Applicator tooling is shown in FIGS. 5A, 5B and 7, and comprises a female die 56, a pressure platen 58 and a toolhead 60. The die 56 includes an integral spindle or mandrel 62, with arcuate recesses 64 at the root of the spindle and flanking either side of the spindle. The apertured conductor 2 is placed over the die 56 with the spindle 62 passing through the aperture 54. The platen 58 is lowered against the array of conductors, holding the same against the female die face at the root of the spindle 62. The platen 58 includes a guide passageway 66 rectangular in section and slidably receiving a terminal 1. The tines 34 register slidably against opposite walls of the passageway 66. The tabs 30 register slidably against opposite walls of the passageway 66. Thereby the terminal 1 and the aperture conductor are aligned by the tooling prior to connection.

The toolhead 60 is tubular with a square cross section, slidably interfitted within and guided by the passageway 66. The end of the toolhead encircles the terminal and registers against the coplanar tabs 30 and leg portions 50. As shown in FIGS. 5A and 5B, the toolhead is driven toward the female die, by a machine or hand tool ram of any well known design, forcing the tines to penetrate through the layers of dielectric, and to pass alongside respective edges of the apertured conductor. The chisel edges of the tines engage the die recesses 64 and force the tines to curl in directions back along themselves until the tines engage the inverted side of the conductor array. Simultaneously, the lances 32 are displaced toward, and into engagement with the top side of the conductor array. As shown in FIGS. 5B and 7, the lances are impaled into the thickness of the conductor and emerge from an inverted side thereof. The tines 34 are curled further until their free ends penetrate into the dielectric 6 and into the inverted side of the conductor. As shown, the plane of the lance or tab extends parallel to the axis of curl. Electrical connection with the conductor is established by the tine free ends and the periphery of each of the impaled lances.

Figure 9:
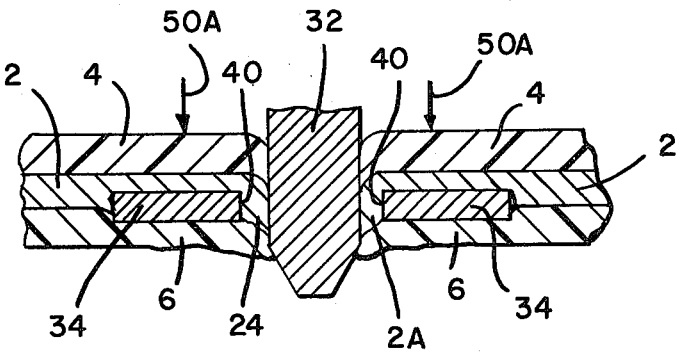
FIG. 9 is another sectional view of the connections of FIG. 7.

It is important that each lance wedges into the conductor, rather than cleanly passing through the conductor. As shown in FIG. 9, when each lance 32 emerges from the inverted side of the conductor, portions 2A of the conductor 2, which contact the sides of the lance, are raised outwardly relative to the plane of the remaining conductor. The corresponding tines 34 straddle opposite sides of the lance, and as the tines continue to curl, the raised portions of the conductor enter the flared opening of the notch 36, and then become wedged between the sides 40 of the notch 36 and the straddled sides of the lance 32. Curling is completed when the tabs 30 and the leg portions 50 are seated against the surface of the conductor array, exerting pressure as shown by arrows 50A, and the tines are tightly curled into the smallest possible loops. When the compressive forces of the tooling are removed from the terminal, the tines have a tendency to uncurl. This causes even more pressure of the tines against the conductor and improves the electrical contact therewith. Loosening of the connection is resisted because the conductor and the leg portion 50 overlie, and thereby, confine the tightly curled ends of the tines within the confines of the connection.

The housing 8, is molded of a rigid dielectric and has a passageway 68 for each terminal 1. When all the desired terminals are installed on the conductor array, the housing is slidably assembled over the terminals. The wall of the box on which the tab 20 is formed deflects resiliently inward of the box shaped terminal, then resiliently springs outward to project the tab 20 into a groove 70 along each passageway 68, latching the tab against a bottom of the groove to retain the housing in place. To remove the housing, a tool must be inserted along each groove 70 to deflect inward each tab 20.

FIG. 2 shows the housing 8 over an array of terminals 1, ready for an array of pins (not shown) of round or square cross sections to be plugged into the open ends of respective terminals contained in respective housing passageways 68. When a pin is correctly aligned during insertion into a respective terminal, the pin will be interposed between the opposed resilient fingers 16 of the terminal and will slightly deflect apart the fingers, storing spring energy in the fingers so that they grip resiliently on opposite sides of the pins. The sidewalls of the respective housing passageway closely surround a respective terminal, so that if either of the fingers 16 is deflected toward a respective passageway sidewall, by a pin which is misaligned during insertion, the outwardly facing edges 16A on the free ends of the fingers 16 will stop against the respective sidewalls. Thus the passageway sidewalls provide stops for the fingers 16 to prevent overstressing thereof.

Although a preferred embodiment of the present invention is disclosed, other embodiments and modifications thereof which would be apparent to one having ordinary skill are intended to be covered by the spirit and scope of the appended claims. For example, either the dielectric 4 or the dielectric 6 may be absent from the conductor array without affecting the electrical connection. In addition, an adequate connection is established by only a single plate 24 having the corresponding pair of curled tines and the lance straddled by the tines. No other additional support, such as the tabs 30, is required. The receptacle portion of the terminal may be of a configuration, and purpose, other than as disclosed.

What is claimed is:

1. An electrical terminal, stamped and formed from a single metal blank, and comprising:

a plate portion;

a rigid columnar lance defined by a multilateral slit in said plate portion and adapted to impale into an electrical conductor from a first side thereof, said plate portion having a first bend and a second, reverse direction bend defining therebetween a leg portion projecting outwardly of the plane of said lance and adapted for registration against a side of said conductor impaled by said lance, a pair of spaced apart tines integral with said lance and having free ends adapted to be curled back upon themselves straddling said lance and penetrating a second side of said conductor, and wedging said conductor against said lance impaled into the thickness of said conductor, said tines in their uncurled form being offset from the plane of said lance.

2. An electrical terminal stamped and formed from a single metal blank, and adapted for electrical connection to an insulation covered electrical conductor, comprising:

a plate portion, a rigid columnar lance defined by a multilateral slit in said plate portion, said plate portion having a first bend and a second, reverse direction bend defining therebetween a leg portion projecting outwardly of the plane of said lance and adapted for registration against a side of said insulation covered conductor impaled by said lance, a pair of spaced apart elongated tines having free ends adapted to penetrate said insulation, and be curled back upon themselves straddling said lance and penetrating both said insulation and a side of said conductor, said tines tending to uncurl against said conductor, and wedging said conductor against said lance impaled into the thickness of said conductor from another side thereof, said tines in their uncurled form being offset from the plane of said lance by said leg portion.

3. An electrical terminal, stamped and formed from a single metal blank, and comprising:

a folded, box shaped receptacle, a pair of spring fingers on opposite sides of said receptacle, a pair of plate portions depending from opposite sides of said receptacle, a lance defined by a multilateral slit in each said plate portion and adapted to impale into an electrical conductor from a first side thereof, each said plate portion having a first bend and a second, reverse direction bend defining therebetween a leg portion projecting outwardly of the plane of said lance and adapted for registration against said first side of said conductor, and a pair of tines on each said plate portion initially offset from the plane of a respective lance by a corresponding leg portion, said tines being adapted to pass alongside a corresponding edge of a conductor and be curled back on themselves, penetrating a second side of said conductor, straddling a respective lance and wedging said conductor against said lance.

4. An electrical connection of an electrical terminal with an assembly wherein a flat conductor is mounted on a sheet of dielectric, comprising:

a stamped and formed metal blank having at least one rigid, dielectric penetrating, lance impaled into said conductor from a first side thereof and emerging from said second side of said conductor, said blank further including at least one pair of, dielectric penetrating, tines passing alongside an edge of said conductor and curled back along themselves and penetrating into a second side of said conductor, said tines straddling sides of a respective said lance and wedging said conductor against the straddled sides of a respective said lance portions of said conductor contacting said lance being raised outwardly of the plane of the remaining conductor, said tines of each said pair wedging said raised portions against said straddled sides of a respective said lance.

5. The structure as recited in claim 4, wherein, a pair of said tines and a respective said lance are formed from a respective plate portion of said blank, each said plate portion having a first bend and a second, reverse direction bend defining therebetween a leg portion connected between said lance and said tines, and projecting outwardly of the plane of said lance and in registration against said conductor.

6. The structure as recited in claim 5, wherein said blank further is provided with a folded, box shaped receptacle, spring fingers defined by respective multilateral slits in opposite sides of said receptacle, and said receptacle having bent tabs coplanar with each said leg portion and in registration against said conductor.

7. An electrical connection between a one-piece stamped and formed metal terminal and a flat metal conductor, the terminal including a tab penetrating a first side of the conductor and a bifurcated portion extending past the conductor from the first to a second side of the conductor having a pair of tines curled back on themselves penetrating the second side of the conductor adjacent respective opposite sides of the tab to press the conductor against the tab, in which the plane of the tab extends parallel to the axis of curl and the tab pierces completely through the conductor with the tines straddling the tab and portions of the conductor engaging the edges of the tab pushed out of the plane of the conductor in wedging engagement with adjacent edges of the respective tines.

8. A one-piece stamped and formed metal terminal for a flat metal conductor comprising a contact portion and a connecting portion, the connecting portion comprising a tab for penetrating a first side of a flat metal conductor and a bifurcated portion having a pair of tines extending in the same direction as the tab on respective opposite sides of the tab, the tines being adapted to be curled back on themselves to penetrate a second side of the conductor, in which the tab and the bifurcated portion extend in substantially parallel planes and are integrally joined at their root ends by a transverse bridging portion.

* * * * *